US006595088B2

(12) United States Patent
Kuo et al.

(10) Patent No.: US 6,595,088 B2
(45) Date of Patent: Jul. 22, 2003

(54) LEVERAGE-RELEASE TYPE SILENT WRENCH STRUCTURE

(76) Inventors: Wen-Jin Kuo, 7F, No. 185, Sec. 2 Nan-Tun Rd., Tai-Chung City (TW); Wen-Chin Kuo, 7F, No. 185, Sec. 2, Nan-Tun Rd., Tai-Chung City (TW)

( * ) Notice: Subject to any disclaimer, the term of this patent is extended or adjusted under 35 U.S.C. 154(b) by 0 days.

(21) Appl. No.: 10/072,041

(22) Filed: Feb. 8, 2002

(65) Prior Publication Data

US 2002/0139223 A1 Oct. 3, 2002

(30) Foreign Application Priority Data

Mar. 28, 2001 (TW) ..... 90204914 U

(51) Int. Cl.[7] ..... B25B 13/46
(52) U.S. Cl. ..... 81/58.5
(58) Field of Search ..... 81/58.5, 58.4, 81/60

(56) References Cited

U.S. PATENT DOCUMENTS 1,087,736 A * 2/1914 Dolan ..... 81/58.5
1,650,085 A * 11/1927 McDonough ..... 81/58.5
5,761,973 A * 6/1998 Tung ..... 81/177.85

FOREIGN PATENT DOCUMENTS

DE 806660 * 7/1949 ..... 81/58.5

* cited by examiner

*Primary Examiner*—D. S. Meislin
(74) *Attorney, Agent, or Firm*—Charles E. Baxley

(57) ABSTRACT

A leverage-release type silent wrench structure comprised of a ratchet wheel and a torsion handle having a hinge section at one end that is situated next to the ratchet wheel. A clutch block curves upward from one side of the hinge section and a toothed surface consisting of a plurality of teeth is disposed along the arc-shaped inner side of the clutch block that provides for enmeshment with the ratchet wheel. A mounting base and a protective cover in an aligned arrangement accommodate the positioning of the ratchet wheel and the hinge section of the torsion handle within them. A linkage component pivotably conjoins the mounting base, the protective cover, and the hinge section of the torsion handle and, furthermore, such that the linkage component serves as the center point of rotation of the torsion handle. Pulling the torsion handle causes its clutch block to move against the ratchet wheel such that the toothed surface enmeshes the ratchet wheel, enabling the torsion handle to initiate the rotation of the ratchet wheel and thereby rotate a work object. Pulling the torsion handle in the opposite direction causes the separation of the toothed surface of the clutch block from the ratchet wheel, enabling the torsion handle to be rotated back to its initial starting position in a disengaged state around the linkage component at the center point.

6 Claims, 7 Drawing Sheets

LEVERAGE-RELEASE TYPE SILENT WRENCH STRUCTURE

BACKGROUND OF THE INVENTION

1) Field of the Invention

The invention herein relates to a wrench tools, specifically a leverage-release type silent wrench structure.

2) Description of the Prior Art

In a conventional ratchet wrench, referring to the structure in FIG. 1, a ratchet wheel is contained in the working end of the wrench, a ball bearing and a spring push against the bottom of a pawl such that one of its corners engage the ratchet wheel, and the pawl is controlled by a toggling lever. The said ratchet wheel is mounted in the working end of the wrench by C-shaped circlips and an upper and lower mounting piece each fastened with two screws. To operate, the user moves the toggling lever to selectively engage one of the pawl corners with the ratchet wheel such that pulling the said wrench in one direction rotates the said ratchet wheel and the work object, while pulling the wrench in the opposite direction disengages the pawl and disables ratchet wheel rotation.

The said solid handle-type ratchet wrench utilizes numerous structural components, its assembly is intricate and tedious, and the quantity of enmeshed teeth between the pawl and the ratchet wheel is comparatively low, resulting in reduced torque. Furthermore, when the wrench is rotated in the disengaged state, friction between the pawl and the ratchet wheel produces an intense clicking noise and silent operation is not possible. When a work object is not fully tightened, since the ratchet wheel cannot be neutrally positioned in coordination with the pawl, as the wrench is pulled back in the disengaged state, the pawl rotates the ratchet wheel and the work object is rotated in the opposite direction such that it is virtually impossible to loosen or tighten work objects so disposed.

SUMMARY OF THE INVENTION

The primary objective of the invention herein is to provide a leverage-release type silent wrench structure that is of simple assembly, noiseless in operation, higher in torque, performance enhancing, and of prolonged service life, wherein when the present invention is utilized on a loose work object, the work object is not affected by drag-induced rotation in the opposite direction as the wrench is pulled back in the disengaged state and, furthermore, in environments of limited angle, the invention herein remains capable of efficiently rotating work objects because it is not impaired by application environment or work object loosening and tightening constraints.

Therefore, the leverage-release type silent wrench structure is comprised of:

A ratchet wheel; the said ratchet wheel having a tool end at its center that is inserted into an attachment.

A torsion handle having a hinge section at one end that is situated next to the said ratchet wheel, with a clutch block curving upward from one side of the said hinge section and a toothed surface consisting of a plurality of teeth disposed along the arc-shaped inner side of the said clutch block that provides for enmeshment with the said ratchet wheel.

A mounting base and a protective cover that are in an aligned arrangement to accommodate the positioning of the ratchet wheel and the hinge section of the torsion handle within them.

A linkage component that pivotably conjoins the said mounting base, protective cover, and hinge section of the torsion handle and, furthermore, such that the linkage component serves as the center point of rotation of the torsion handle.

Given the said structure, pulling the said torsion handle with the linkage component serving as the center point of the said torsion handle causes its clutch block to move against the said ratchet wheel such that the toothed surface enmeshes the ratchet wheel, enabling the said torsion handle to initiate the rotation of the said ratchet wheel and thereby rotate a work object; pulling the torsion handle in the opposite direction causes the separation of the toothed surface of the clutch block from the ratchet wheel, enabling the said torsion handle to be rotated back to its initial starting position in a disengaged state around the said linkage component at the center point.

DETAILED DESCRIPTION OF THE INVENTION

Figure 1:
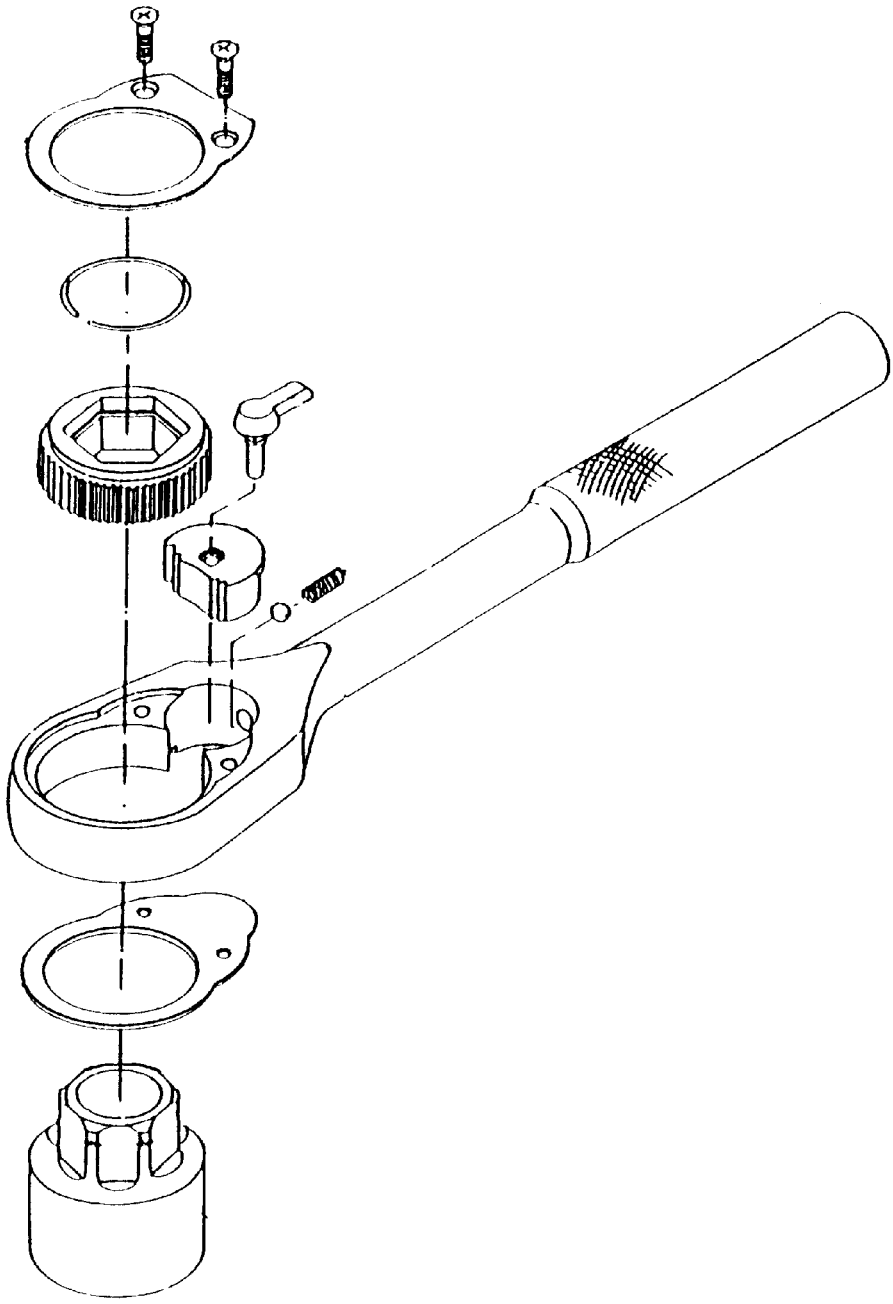
FIG. 1 PRIOR ART
FIG. 1 is an exploded drawing of a conventional ratchet wrench.
Figure 2:
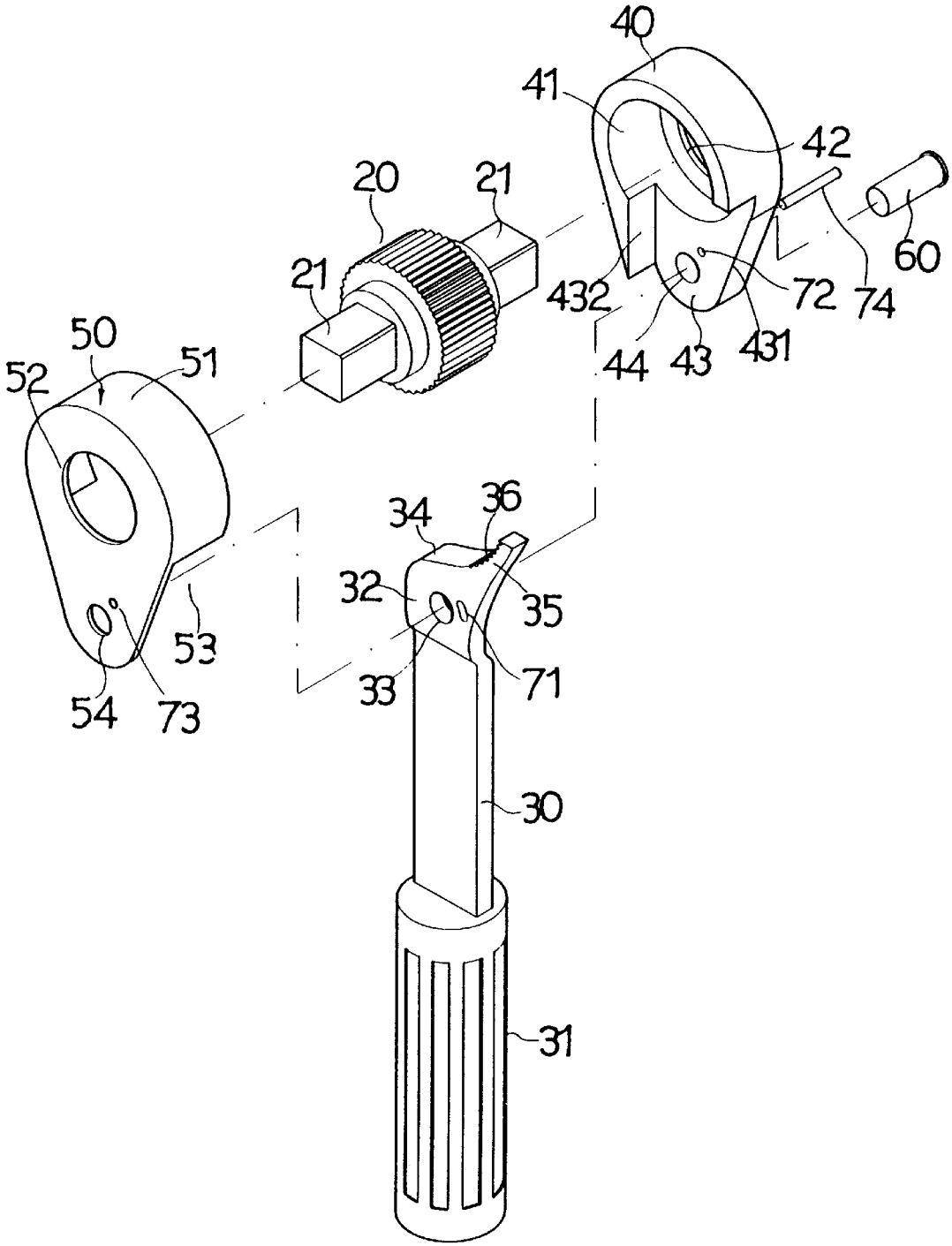
FIG. 2 is an exploded drawing of the first embodiment of the invention herein.
Figure 3:
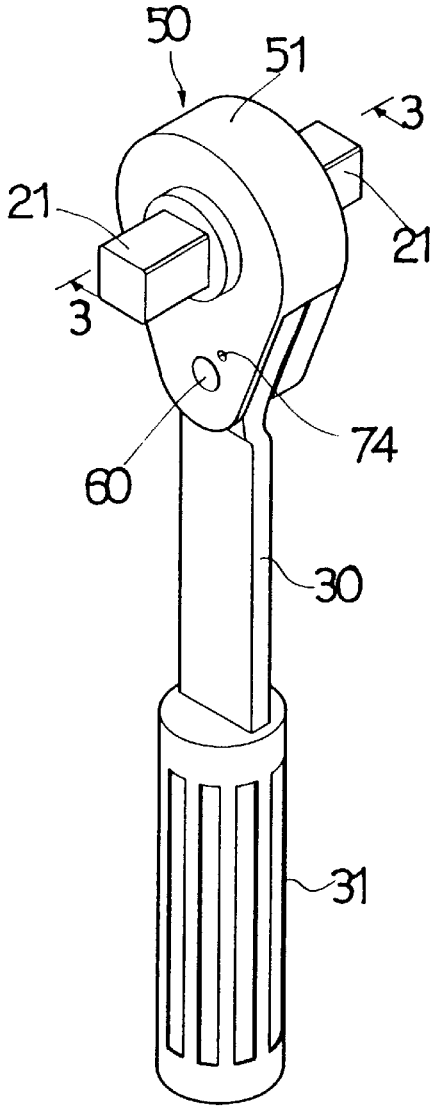
FIG. 3 is an isometric drawing of the first embodiment of the invention herein.
Figure 4:
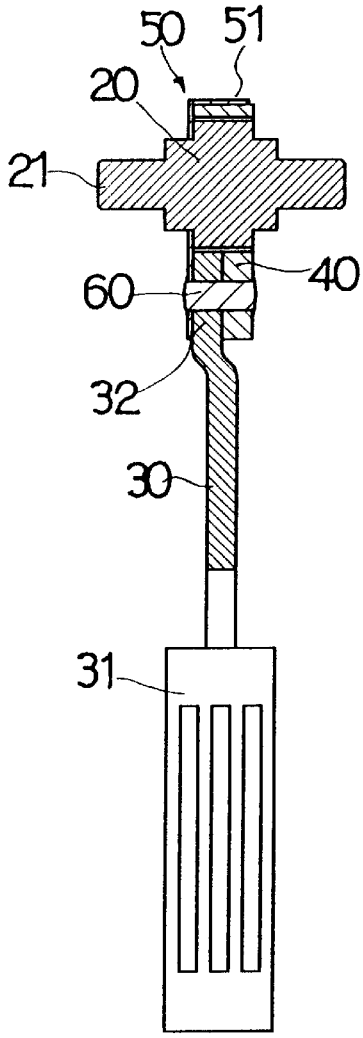
FIG. 4 is a partial cross-sectional drawing of FIG. 3 as viewed from the perspective of line 3—3.
Figure 7:
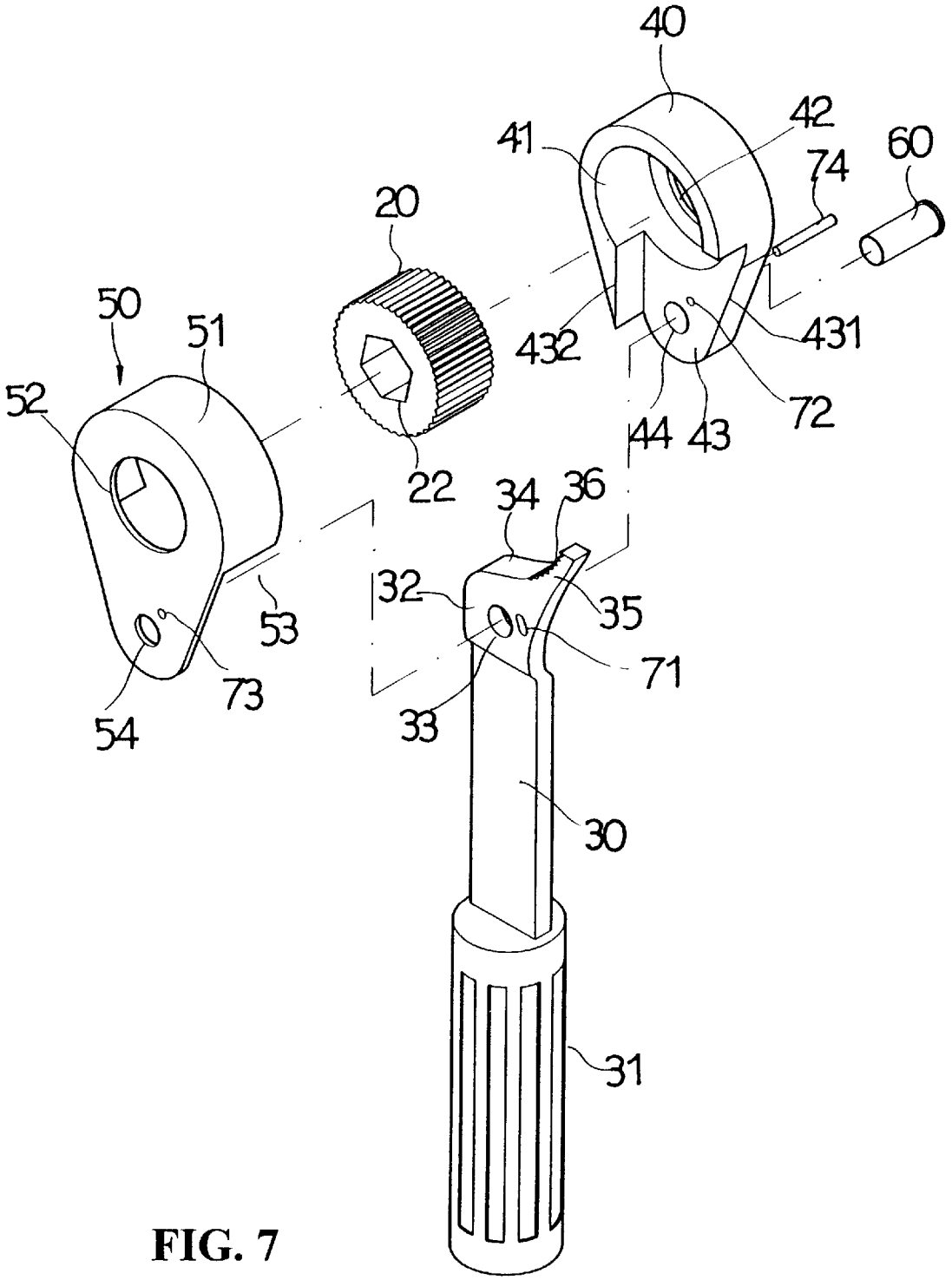
FIG. 7 is an exploded drawing of the second embodiment of the invention herein.

Referring to FIG. 2, FIG. 3, and FIG. 4, the leverage-release silent wrench structure of the invention herein is comprised of:

A ratchet wheel 20; the said ratchet wheel 20 having a tool end at its center and, as indicated in FIG. 2, the tool end consists of a drive tip 21 extending from two sides or, as indicated in FIG. 7, a six-point hex socket 22.

A torsion handle 30 at the lower extent of the said ratchet wheel 20 with a grip 31 sleeved over one end that provides for manual grasping the by user, the other end consisting of a hinge section 32 extending in a curve towards the side of the handle having a pivot hole 33 in the center, a shoulder section 34 along the top edge utilized to support the said ratchet wheel 20, a clutch block 35 curving upward from one side of the said shoulder section 34, and a contoured toothed surface 36 disposed along the arc-shaped inner side of the said clutch block 35 that engages the said ratchet wheel 20.

A mounting base 40 consisting of an inverted tear drop-shaped substructure having an installation opening 41 at its center with a diameter accommodating that of the said ratchet wheel 20 and that provides for the placement of the said ratchet wheel 20 such that it is still capable of rotation; a lip 42 disposed along the inner rim of the said installation opening 41 that laterally checks the said ratchet wheel 20 and prevents the dislodging of the said ratchet wheel 20; a recessed space 43 formed laterally under the said mounting base 40 that provides for the positioning of the torsion handle 30 hinge section 32; a breach 431 disposed at one side of the said recessed space 43 that provides for the movement of the said torsion handle 30, with a restraint face 432 situated on its other side that stops the said hinge section 32; and a pivot hole 44 formed in the center of the recessed space 43 side wall that is aligned with the pivot hole 33 of the said hinge section 32.

A protective cover 50 consisting of an inverted tear drop-shaped hollow casing having a completely open side, a closed side, a surrounding wall 51 along its outer periphery that encloses the said mounting base 40, a work opening 52 in the closed side that exposes the ratchet wheel 20 drive tip 21 or the six-point hex socket 22, a clearance opening 53 in the said surrounding wall 51 that is aligned with the breach 431 of the said mounting base 40 and provides for the rotation of the said torsion handle 30, and a pivot hole 54 in the closed side that is aligned with the said pivot hole 33.

A linkage component 60 (a rivet) that is inserted through the respective pivot holes 44, 33, and 54 of the said mounting base 40, torsion handle 30, and protective cover 50 to conjoin them such that the linkage component 30 serves as a center point of rotation of the torsion handle 30.

A rotation direction positioning structure consisting of an arced hole 71 adjacent to the hinge section 32 pivot hole 33 of the said torsion handle 30 and concentric with the pivot hole 33 as well as a small hole 72 and 73 in the said mounting base 40 and the said protective cover 50, respectively, that are aligned with the said arced hole 71 and provide for the insertion of a pin 74, the two extremities of which are situated in the said small holes 72 and 73 such that the pin 74 is capable of movement within the said arced hole 71.

Figure 5:
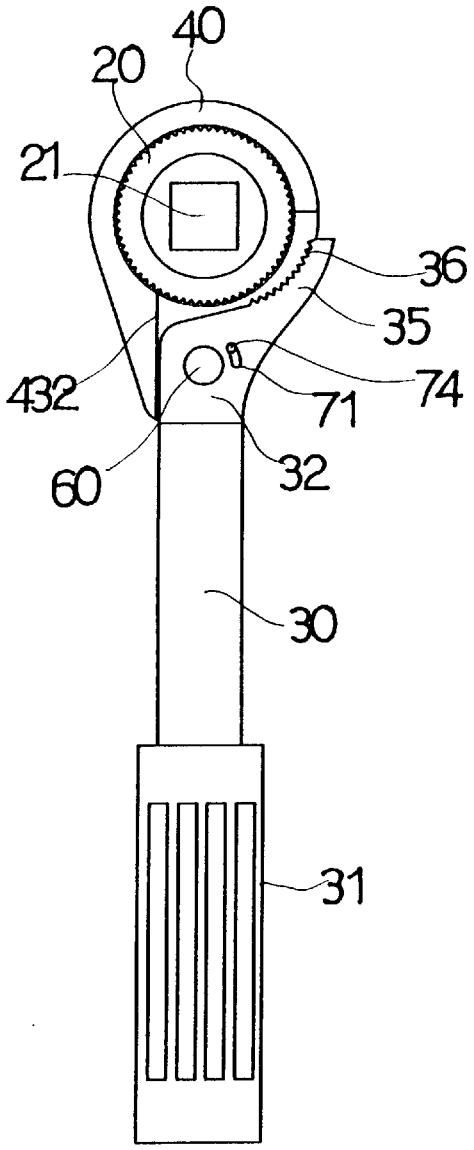
FIG. 5 is an orthographic drawing of the first embodiment of the invention herein.
Figure 6:
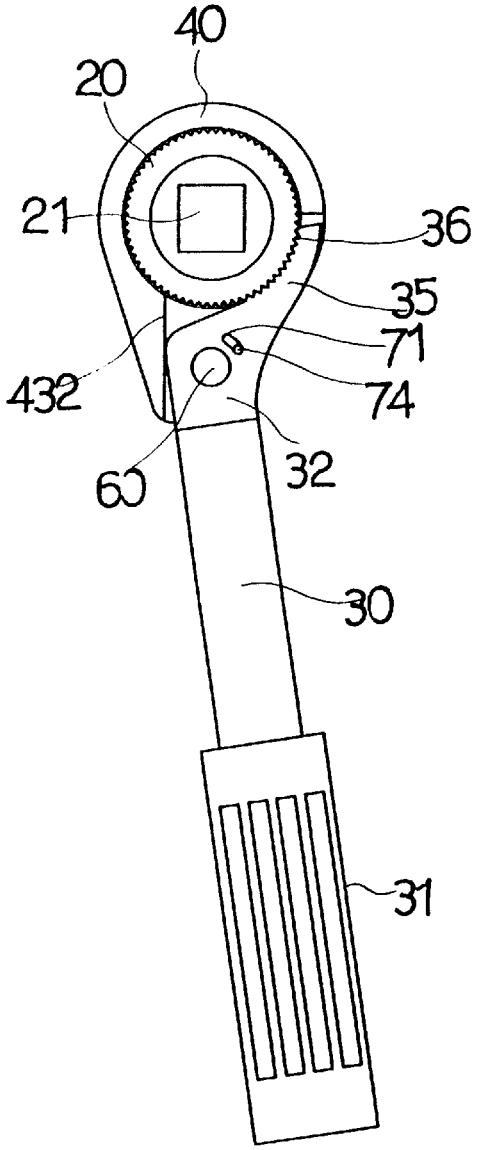
FIG. 6 is an orthographic drawing of the first embodiment torsion handle of the invention herein.

Referring to FIG. 5 and FIG. 6, when the torsion handle 30 of the invention herein is pulled around the linkage component 60 serving as a center point, the torsion handle 30, in conjunction with the clutch block 35 at the other end, functions as a lever; specifically, when the torsion handle 30 is pulled in one direction, the said clutch block 35 moves in the opposite direction. Utilizing this principle of motion, the ratchet wheel 20 drive tip 21 or the six-point hex socket 22 is placed on the work object and the torsion handle 30 is pulled counter-clockwise for a certain distance (as shown in FIG. 6), causing the clutch block 35 to move against the ratchet wheel 20 until its toothed surface 36 is fully enmeshed with the ratchet wheel 20, at which time the torsion handle 30 rotates the said ratchet wheel 20 to loosen or tighten the work object. When the said torsion handle 30 has been rotated a certain extent, it is normally rotated back to the starting position of the pull to thereby function as an appropriate and, furthermore, convenient manually operation tool. When the torsion handle 30 is reverse rotated, the toothed surface 36 of the said clutch block 35 completely separates from the said ratchet wheel 20 and the said torsion handle 30 is rotated back to the initial position in a disengaged state around the said linkage component 60 at the center point in preparation for the next pulling operation.

The rotation direction positioning structure is an auxiliary structure; as indicated in FIG. 6, when the torsion handle 30 causes the enmeshment of the clutch block 35 toothed surface 36 to the ratchet wheel 20, the said pin 74 is positioned against the lower end of the arced hole 71 such that the user can visually ascertain that the toothed surface 36 of the clutch block 35 is already enmeshed with the ratchet wheel 20 and then proceed to pull the torsion handle 30 to rotate the said ratchet wheel 20 and the work object. Conversely, as indicated in FIG. 5, when the torsion handle 20 is pulled in the opposite direction, in addition to the side portion of the said hinge section 32 becoming situated against the restraint face 432 of the mounting base 40, the said pin 74 is positioned against the upper end of the arced hole 71, allowing the user to know that the clutch block 35 is already separated from the ratchet wheel 20.

Figure 8:
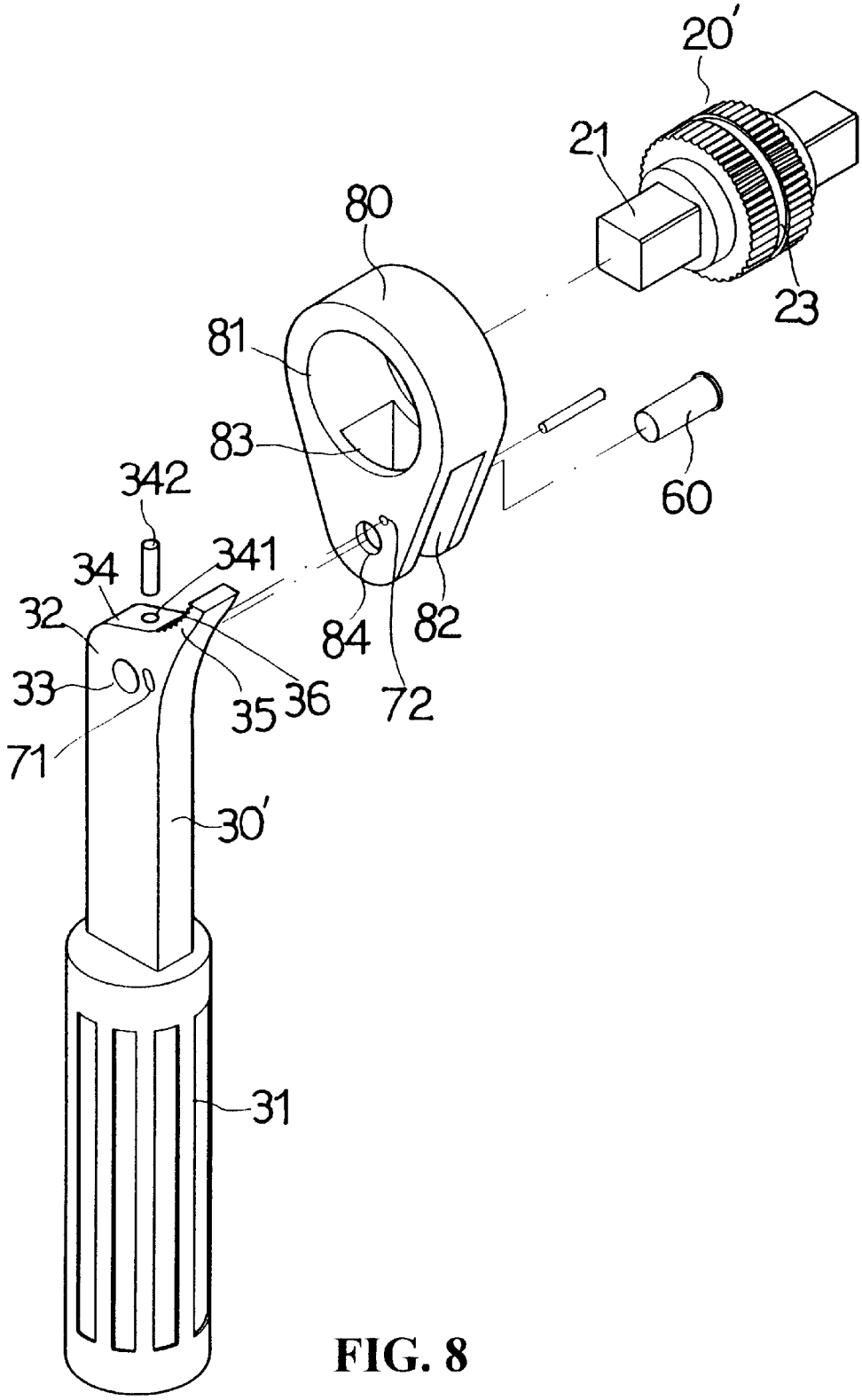
FIG. 8 is an exploded drawing of the third embodiment of the invention herein.
Figure 9:
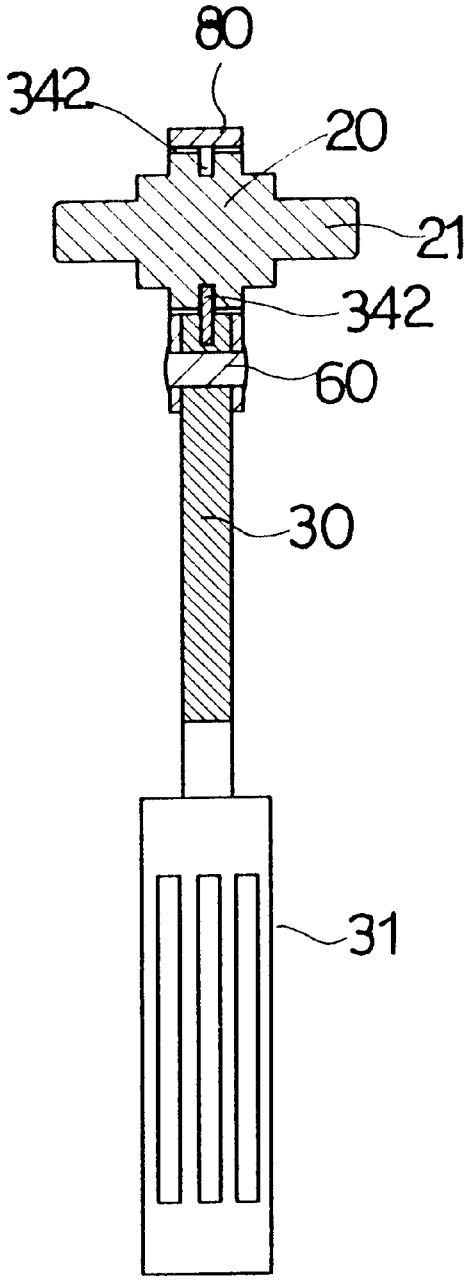
FIG. 9 is a partial cross-sectional drawing of the third embodiment of the invention herein.

Referring to FIG. 8 and FIG. 9, the third embodiment of the invention herein is comprised of:

A ratchet wheel 20'; as indicated in FIG. 8, the said ratchet wheel 20' has disposed through its center a drive tip 21 extending from two sides or, as indicated in FIG. 7, a six-point hex socket 22, with the said ratchet wheel 20' also having a groove 23 formed around its circumference.

A protective housing 80 consisting of an inverted tear drop-shaped hollow casing, wherein an installation opening 81 is formed at the center with a diameter accommodating that of the said ratchet wheel 20 and that provides for the placement and rotation of the said ratchet wheel 20; a clearance space 82 is formed in the bottom section of the said protective housing 80 and an entrance 83 contiguous with the clearance space 82 is disposed under the said installation opening 81 to partially expose the ratchet wheel 20' at the entrance 83; and a pivot hole 84 is formed in each of the two side walls of the said clearance space 82.

A torsion handle 30' at the lower extent of the said ratchet wheel 20' with a grip 31 sleeved over one end that provides for manual grasping the by user; the other end consisting of a hinge section 32 situated in the clearance space 82 of the said protective housing 80, with a pivot hole 33 formed in the center of the said hinge section 32 that is aligned with the protective housing 80 pivot hole 84 and which provides for the insertion of a linkage component 60 through both said pivot holes 33 and 84 such that the said linkage component 60 serves as a center point around which the torsion handle 30' is pulled as positioned in the clearance space 82 of the said protective housing 80; a shoulder section 34 along the top edge of the said hinge section 32 utilized to support the said ratchet wheel 20'; a ratchet wheel positioning structure consisting of a locating hole 341 vertically formed into the center of the said shoulder section 34 and a pin 342 inserted therein, with the top end of the said pin 342 projecting from the said shoulder section 34 firmly ensconced in the groove 23 of the said ratchet wheel 20' to keep the said ratchet wheel 20' from dropping out of the said protective housing 80; a clutch block 35 curves upward from one side of the said shoulder section 34 and a toothed surface 36 is disposed along the arc-shaped inner side of the said clutch block 35 to provide for enmeshment with the ratchet wheel 20'.

A rotation direction positioning structure consisting of an arced hole 71 adjacent to hinge section 32 pivot hole 33 of the said torsion handle 30' and concentric with the pivot hole 33 as well as a small hole 72 in each of the two side walls of the said protective housing 80 that are aligned with the said arced hole 71 and provide for the insertion of a pin 74, the two extremities of which are situated in the said small holes 72 such that the pin 74 is capable of movement within the said arced hole 71.

Since the operation of the second embodiment herein is generally quite similar to that of the first embodiment herein, it shall not be considerably elaborated . However, the difference between it and the first embodiment is the structure in which the said pin 342 projects into the said ratchet wheel 20' groove 23, with the said arrangement positioning and preventing the dropping out of the said ratchet wheel 20'; when the torsion handle 30' is pulled to operate the ratchet wheel 20', the said pin 342 slants as it accompanies the movement of the said torsion handle 30' and although it is not displaced from the said ratchet wheel 20' groove 23, the following must be noted with regard to prevention. The said rotation direction positioning structure is utilized to prevent the pin 342 from slanting out of the groove 23 due to excessive pulling of the ratchet wheel 20' by the user; the coordinated relationship between the rotation direction positioning structure and the torsion handle 30 of the first embodiment has been previously described and shall not be further elaborated.

In summation of the foregoing section, the first, second, and third embodiments of the invention herein possess the following advantages:

1. Since the torsion handle 30 and 30' is capable of controlling the engagement and disengagement of its clutch block 35 tooth surfaces 36 to and from the ratchet wheel 20 and 20', when the torsion handle 30 and 30' is engaged, it drives the said ratchet wheel 20 and 20' into rotation to loosen or tighten a work object; when the torsion handle 30 and 30' is disengaged, it is capable of being rotated back unencumbered by mechanical contact; during return rotation in the disengaged state, since the tooth surfaces 36 are fully separated from the ratchet wheel 20 and 20', no ratchet teeth clicking noise is frictionally generated to thereby achieve the objective of silent operation.

2. The torsion handle 30 and 30' of the invention herein is enmeshed with the ratchet wheel 20 and 20' by means of a plurality of teeth disposed on its toothed surface 36 such that when force is exerted to pull the torsion handle 30 and 30' and thereby rotate the ratchet wheel 20 and 20' to drive a work object, ratchet teeth breakage does not occur because stress is distributed among the plurality of teeth and interdental notches of the toothed surface 36; correspondingly, a greater magnitude of torque capacity is available to withstand the application of extreme strength by the user to tighten work objects and the bearing of larger sudden bursts of force to loosen or tighten work objects. The invention herein has a higher range of torque and durable structure that facilitates operating efficiency and, furthermore, provides for prolonged service life.

3. When the torsion handle 30 and 30' of the invention herein is rotated back, since the clutch block 35 toothed surfaces 36 are totally isolated from the ratchet wheel 20 and 20', the ratchet wheel 20 and 20' is not subject to any drag during the return rotation stroke and, furthermore, a work object being loosened is not affected by drag-induced rotation in the opposite direction, an advantage that is also relevant handy in environments that limit pulling angles, where the rotation of the torsion handle 30 and 30' is physically constrained and curtails the number of degrees work objects can be turned; however, since work objects being loosened are not affected by drag-induced rotation when the torsion handle 30 and 30' is pulled in the opposite direction, working object can be efficiently unfastened utilizing the smallest available degree of angular rotation and tightening work objects in the opposite direction can be similarly accomplished by articulating numerous short pulls.

4. The invention herein has fewer structural components and, furthermore, is simple to assemble and easy to accurately position, which are improvements upon the numerous structural component requirement and assembly problems of conventional ratchet wrenches

What is claimed is:

1. leverage-release type silent wrench structure comprised of:

a ratchet wheel; said ratchet wheel having a tool end at its center that is inserted into an attachment:

additionally, a groove formed around its circumference of said ratchet wheel;

a torsion handle having a hinge section at one end that is situated next to said ratchet wheel, with a clutch block extending in a curve from one side of said hinge section;

a toothed surface disposed along the curved inner side of said clutch block that provides for enmeshment with said ratchet wheel;

a protective housing that encases the said ratchet wheel and the said torsion handle hinge section;

a ratchet wheel positioning structure consisting of a locating hole formed in the center of said hinge section top surface and a pin insert therein, with the top end of said pin projecting into and firmly ensconced in said groove of said ratchet wheel to keep said ratchet wheel from dropping out of said protective housing;

a linkage component that pivotably conjoins said protective housing and said hinge section of said torsion handle and, furthermore, such that said linkage component serves as a center point of rotation of said torsion handle;

wherein pulling said torsion handle with said linkage component serving as the center point of said torsion handle causes its said clutch block to move against said ratchet wheel such that said toothed surface enmeshes said ratchet wheel, enabling said torsion handle to initiate the rotation of said ratchet wheel, and thereby rotate a work object;

pulling said torsion handle in the opposite direction causes the separation of the said toothed surface of the said clutch block from said ratchet wheel, enabling said torsion handle to be rotated back to its initial starting position in a disengaged state around said linkage component at the center point.

2. The leverage-release type silent wrench structure in accordance with claim 1 wherein said tool end consists of a cornered insertable column extending from two sides of said ratchet wheel.

3. The leverage-release type silent wrench structure in accordance with claim 1, wherein said torsion handle has a grip sleeved over its free end that provides for manual grasping the by user.

4. The leverage-release type silent wrench structure in accordance with claim 1 wherein said protective housing consists of an installation opening at its center that provides for the placement and rotation of said ratchet wheel;

a clearance space is formed in the bottom section of said protective housing that provides for the placement of said torsion handle hinge section;

an entrance contiguous with the clearance space disposed under said installation opening that provides for the enmeshment of said toothed surface of said torsion handle clutch block to said ratchet wheel; and a pivot hole respectively formed in each of the two side walls of said clearance space as well as in said torsion handle hinge section that provides for the insertion of the said linkage component.

5. The leverage-release type silent wrench structure in accordance with claim 4 wherein the present invention is also comprised of a rotation direction positioning structure consisting of an arced hole at said torsion handle hinge section and concentric with said linkage component as well as a small hole in said mounting base and said protective housing, respectively, that are aligned with said arced hole and provide for the insertion of a pin, the two extremities of which are situated in said small holes such that said pin is capable of movement within said arced hole;

when said torsion handle causes the enmeshment of said clutch block toothed surface to said ratchet wheel, said pin is positioned against one end of said arced hole; and when the said torsion handle is pulled back in the opposite direction to separate said clutch block toothed surface from said ratchet wheel, said pin is positioned against the other end of said arced hole.

6. A leverage-release type silent wrench structure comprised of:

a ratchet wheel; said ratchet wheel having a tool end at its center that is inserted into an attachment;

a torsion handle having a hinge section at one end that is situated next to the said ratchet wheel, with a clutch block extending in a curve from one side of said hinge section and a toothed surface disposed along the curved inner side of said clutch block that provides for enmeshment with said ratchet wheel;

a mounting base and a protective cover that are in an aligned arrangement to accommodate the positioning of said ratchet wheel and said hinge section of said torsion handle within them;

a linkage component that pivotably conjoins said mounting base, said protective cover, and said hinge section of said torsion handle and furthermore, such that said linkage component serves as the center point of rotation of said torsion handle;

wherein pulling said torsion handle with said linkage component serving as the center point of said torsion handle causes its said clutch block to move against said ratchet wheel such that said toothed surface enmeshes said ratchet wheel, enabling said torsion handle to initiate rotation of said ratchet wheel and thereby rotate a work object;

pulling said torsion handle in the opposite direction causes the separation of said toothed surface of said clutch block from said ratchet wheel, enabling the said torsion handle to be rotated back to its initial starting position in a disengaged state around said linkage component at the center point, wherein said mounting base consists of an installation opening at its center that provides for the placement of said ratchet wheel such that it is still capable of rotation;

a lip disposed along the inner rim of said installation opening that laterally confines said ratchet wheel; a recessed space formed laterally under said mounting base that provides for the positioning of said torsion handle hinge section; and aligned pivot holes in said linkage component, and wherein said protective cover consists of a completely open side, a closed side, a surrounding wall along its outer periphery that encloses said mounting base, a work opening in the closed side that exposes said ratchet wheel tool end, and a pivot hole aligned with respective said pivot holes of said mounting base and said torsion handle that provides for the insertion of said linkage component.

* * * * *